US011255326B2

(12) United States Patent
Holbrook et al.

(10) Patent No.: US 11,255,326 B2
(45) Date of Patent: Feb. 22, 2022

(54) OFFSET STATOR BORES FOR PUMP SEALING

(71) Applicant: Edwards Limited, Burgess Hill (GB)

(72) Inventors: Alan Ernest Kinnaird Holbrook, Burgess Hill (GB); David Bedwell, Burgess Hill (GB)

(73) Assignee: Edwards Limited, West Sussex (GB)

( * ) Notice: Subject to any disclaimer, the term of this patent is extended or adjusted under 35 U.S.C. 154(b) by 216 days.

(21) Appl. No.: 16/480,103

(22) PCT Filed: Jan. 11, 2018

(86) PCT No.: PCT/GB2018/050068
§ 371 (c)(1),
(2) Date: Jul. 23, 2019

(87) PCT Pub. No.: WO2018/138475
PCT Pub. Date: Aug. 2, 2018

(65) Prior Publication Data

US 2019/0376516 A1 Dec. 12, 2019

(30) Foreign Application Priority Data

Jan. 24, 2017 (GB) ..... 1701179

(51) Int. Cl.
*F04C 18/08* (2006.01)
*F04C 11/00* (2006.01)
(Continued)

(52) U.S. Cl.
CPC ..... *F04C 18/126* (2013.01); *F04C 11/001* (2013.01); *F04C 18/086* (2013.01); *F04C 2240/30* (2013.01); *F04C 2270/17* (2013.01)

(58) Field of Classification Search
CPC ..... F04C 18/126; F04C 18/086; F04C 18/08; F04C 18/082; F04C 11/001; F04C 2/088; F01C 21/02
(Continued)

(56) References Cited

U.S. PATENT DOCUMENTS

2004/0228752 A1* 11/2004 Peters ..... F04C 15/003 418/206.4
2010/0104464 A1* 4/2010 Schofield ..... F04C 18/126 418/206.1

FOREIGN PATENT DOCUMENTS

CN 1298474 A 6/2001
CN 2656674 Y 11/2004
(Continued)

OTHER PUBLICATIONS

British Search Report dated Jul. 24, 2017 and Examination Report dated Jul. 25, 2017 for corresponding British Application No. GB1701179.2.
(Continued)

*Primary Examiner* — Deming Wan
(74) *Attorney, Agent, or Firm* — Theodore M. Magee; Westman, Champlin & Koehler, P.A.

(57) ABSTRACT

A pump includes a first housing part defining a first portion of a bore extending within the first housing part and shaped to receive a rotor; and a second housing part defining a second portion of the bore extending within the second housing part and shaped to receive the rotor. The first housing part has a first face abutable against an opposing second face of the second housing part to position the first portion of the bore with the second portion of the bore to receive the rotor. The first portion of the bore has a first circular cross-section portion centered along the first face and the second portion of the bore having a second circular
(Continued)

cross-section portion centered, within the second housing part, at a distance from the second face.

20 Claims, 3 Drawing Sheets

(51) Int. Cl.
*F04C 23/00* (2006.01)
*F04C 18/12* (2006.01)
*F01C 21/02* (2006.01)

(58) Field of Classification Search
USPC ..... 418/206.1
See application file for complete search history.

(56) References Cited

FOREIGN PATENT DOCUMENTS

| | | | |
|---|---|---|---|
| CN | 1500674 | A | 12/2004 |
| CN | 1550674 | A | 12/2004 |
| CN | 101815873 | A | 8/2010 |
| CN | 103443400 | A | 12/2013 |
| DE | 279716 | A1 | 6/1990 |
| EP | 1256720 | A2 | 11/2002 |
| EP | 2180188 | A1 | 4/2010 |
| GB | 2500603 | A | 10/2013 |
| GB | 2508405 | A | 6/2014 |
| JP | 2003161277 | A | 6/2003 |
| JP | 2004346748 | A | 12/2004 |
| JP | 2009270581 | A | 11/2009 |
| JP | 2010540832 | A | 12/2010 |
| JP | 2012021450 | A | 2/2012 |
| JP | 2015535572 | A | 12/2015 |
| TW | 200925466 | A | 6/2009 |
| TW | 201621167 | A | 6/2016 |
| WO | 2009044197 | A2 | 4/2009 |

OTHER PUBLICATIONS

PCT International Search Report and Written Opinion dated Mar. 14, 2018 for corresponding PCT Application No. PCT/GB2017/050068.

Taiwanese Office Action dated Feb. 24, 2021 and Search Report dated Feb. 23, 2021 for corresponding Taiwanese application Serial No. 107102556, 3 pages.

First Office Action for corresponding Chinese Patent Application No. 201880008369.3, dated Mar. 20, 2020.

English Translation of Chinese Search Report for corresponding Chinese Patent Application No. 20180008369.3, dated Mar. 14, 2020.

Japanese Notification of Reason for Rejection dated Sep. 22, 21 for corresponding Japanese application Serial No. 2019-539956, 3 pages.

* cited by examiner

OFFSET STATOR BORES FOR PUMP SEALING

CROSS-REFERENCE OF RELATED APPLICATION

This application is a Section 371 National Stage Application of International Application No. PCT/GB2018/050068, filed Jan. 1, 2018, and published as WO 2018/138475 A1 on Aug. 2, 2018, the content of which is hereby incorporated by reference in its entirety and which claims priority of British Application No. 1701179.2, filed Jan. 24, 2017.

FIELD

The present invention relates to a pump assembly.

BACKGROUND

Compressors and vacuum pumps are known. Vacuum pumps are typically employed as a component of a vacuum system to evacuate devices. Also, these pumps are used to evacuate fabrication equipment used in, for example, the production of semi-conductors. Rather than performing compression from a vacuum to atmosphere in a single stage using a single pump, it is known to provide multi-stage vacuum pumps where each stage performs a portion of the complete compression range required to transition from a vacuum to atmospheric pressure. Similar arrangements exist for compressors.

Although such compressors and vacuum pumps provide advantages, they also have their own shortcomings. Accordingly, it is desired to provide an improved arrangement for multi-stage pumps.

The discussion above is merely provided for general background information and is not intended to be used as an aid in determining the scope of the claimed subject matter. The claimed subject matter is not limited to implementations that solve any or all disadvantages noted in the background.

SUMMARY

According to a first aspect, there is provided a pump, comprising: a first housing part defining a first portion of a bore extending within the first housing part and shaped to receive a rotor; and a second housing part defining a second portion of the bore extending within the second housing part and shaped to receive the rotor, the first housing part having a first face abutable against an opposing second face of the second housing part to position the first portion of the bore with the second portion of the bore to receive the rotor, the first portion of the bore having a first circular cross-section portion centered along the first face and the second portion of the bore having a second circular cross-section portion centered, within the second housing part, at a distance from the second face.

The first aspect recognises that leakage can occur within a pump, due to the need to provide an adequate running-fit between a rotor and a receiving bore within its stator. In particular, the first aspect recognises that the relative dimensioning of the rotor to the bore within the stator needs to accommodate manufacturing tolerances in order that the rotor does not bear onto the stator and cause damage. Accordingly, a pump is provided. The pump is a vacuum pump or a compressor. The pump comprises a first housing part. The first housing part defines or provides a first portion of a bore or aperture which extends within that housing part and which is shaped or dimensioned to receive a rotor. The pump also comprises a second housing part which defines or provides a second portion of the bore. The second portion of the bore also extends or be provided within the second housing part and be shaped to receive the rotor. The first housing part has a face or surface which is abutable against, or joinable with, an opposing face or surface of the second housing part, in order to position or co-locate the portions of the bore to receive the rotor. The first portion of the bore has a circular cross-section portion. That circular cross-section portion has its centreline located along the first face. The second portion of the bore also has a circular cross-section portion. The centreline of that circular cross-section portion is located within or into the second housing part at a distance or position which is offset from the second face. In this way, a reduced-size bore can be provided which reduces leakage while also providing for adequate running-clearance between the rotor and the bore.

In one embodiment, a radius of the first circular cross-section portion and the second circular cross-section portion match an external radius of a portion of the rotor receivable therein. Accordingly, the radius of the circular cross-section portions may be dimensioned to match or correspond with the external radius of the portion of the rotor.

In one embodiment, the first portion of the bore defines a first hemi-cylinder portion having a longitudinal axis extending along the first face. Accordingly, half-cylindrical portions may be provided whose elongate axis is located along the first face.

In one embodiment, the second portion of the bore defines a second hemi-cylinder portion having a longitudinal axis extending parallel to the second face, within the second housing part at the distance from the second face. Accordingly, the second half cylindrical portion may also be orientated with its elongate axis extending parallel to the second face, but offset spatially into the second housing part.

In one embodiment, the second portion of the bore has extension portions extending from the second circular cross-section portion to the second face.

In one embodiment, the extension portions extend tangentially from either end of the second circular cross-section portion to the second face.

In one embodiment, the extension portions have a length which matches the distance from the second face.

In one embodiment, the first portion of the bore comprises a pair of intersecting first circular cross-section portions centered along the first face. Accordingly, a roots-type chamber may be defined.

In one embodiment, the first portion of the bore defines a pair of intersecting first hemi-cylinder portions having a longitudinal axis extending along the first face.

In one embodiment, the second portion of the bore defines a pair of intersecting second circular cross-section portions centered, within the second housing part, at the distance from the second face.

In one embodiment, the second portion of the bore defines a pair of intersecting second hemi-cylinder portions having a longitudinal axis extending parallel to the second face, within the second housing part at the distance from the second face.

In one embodiment, the extension portions extend tangentially from either non-intersecting end of the second circular cross-section portions to the second face.

In one embodiment, the distance comprises up to a location tolerance of the first face of the first housing part. Accordingly, the location of the centreline of the second circular cross-section portion may be offset into the second housing part by the location uncertainty of the first face of the first housing part.

In one embodiment, the distance comprises up to the location tolerance of the first face of the first housing part together with a displacement tolerance of the rotor. Accordingly, the centreline of the second circular cross-section portion may be offset into the second housing part by a further distance related to a displacement tolerance of the rotor.

In one embodiment, the first housing part defines a plurality of first portions of bores shaped to receive the rotor and the second housing part defines a plurality of second portions of bores shaped to receive the rotor.

In one embodiment, a radius of a first circular cross-section and a second circular cross-section portion of each bore matches an external radius of a portion of the rotor received therein.

In one embodiment, the first portion of each bore has a first circular cross-section centered along the first face and the second portion of each bore has a second circular cross-section portion centered, within the second housing part, at the distance from the second face.

In one embodiment, each bore has the second circular cross-section portion centered, within the second housing part, at the same distance from the second face.

In one embodiment, the first portion of each bore is centered, within a bore position tolerance, from the first face. Accordingly, the centreline of each bore may be positioned within a bore-positioning tolerance. Typically, though not necessarily, the bore-positioning tolerance is considerably less than the location tolerance or the displacement tolerance.

In one embodiment, the first portion of each bore is centered, within the bore position tolerance together with a displacement tolerance of the rotor, from the first face.

According to a second aspect, there is provided a method, comprising: defining a first portion of a bore shaped to receive a rotor and extending within a first housing part; defining a second portion of the bore shaped to receive the rotor and extending within a second housing part the first housing part having a first face abutable against an opposing second face of the second housing part to position the first portion of the bore with the second portion of the bore to receive the rotor, centering the first portion of the bore having a first circular cross-section portion along the first face and centering the second portion of the bore having a second circular cross-section portion, within the second housing part, at a distance from the second face.

In one embodiment, the method comprises matching a radius of the first circular cross-section portion and the second circular cross-section portion with an external radius of a portion of the rotor receivable therein.

In one embodiment, the method comprises defining a first hemi-cylinder portion having a longitudinal axis extending along the first face as the first portion of the bore.

In one embodiment, the method comprises defining a second hemi-cylinder portion having a longitudinal axis extending parallel to the second face, within the second housing part at the distance from the second face as the second portion of the bore.

In one embodiment, the method comprises providing extension portions extending from the second circular cross-section portion to the second face.

In one embodiment, the method comprises extending the extension portions tangentially from either end of the second circular cross-section portion to the second face.

In one embodiment, the method comprises matching a length of the extension portions with the distance from the second face.

In one embodiment, the method comprises providing a pair of intersecting first circular cross-section portions centered along the first face as the first portion of the bore.

In one embodiment, the method comprises providing a pair of intersecting first hemi-cylinder portions having a longitudinal axis extending along the first face as the first portion of the bore.

In one embodiment, the method comprises providing a pair of intersecting second circular cross-section portions centered, within the second housing part, at the distance from the second face as the second portion of the bore.

In one embodiment, the method comprises providing a pair of intersecting second hemi-cylinder portions having a longitudinal axis extending parallel to the second face, within the second housing part at the distance from the second face as the second portion of the bore.

In one embodiment, the method comprises extending the extension portions tangentially from either non-intersecting end of the second circular cross-section portions to the second face.

In one embodiment, the distance comprises up to a location tolerance of the first face of the first housing part.

In one embodiment, the distance comprises up to the location tolerance of the first face of the first housing part together with a displacement tolerance of the rotor.

In one embodiment, the method comprises defining a plurality of first portions of bores shaped to receive the rotor in the first housing part and defining a plurality of second portions of bores shaped to receive the rotor in the second housing part.

In one embodiment, a radius of a first circular cross-section and a second circular cross-section portion of each bore matches an external radius of a portion of the rotor received therein.

In one embodiment, the method comprises centering a first circular cross-section as the first portion of each bore along the first face and centering a second circular cross-section portion as the second portion of each bore, within the second housing part, at the distance from the second face.

In one embodiment, the method comprises centering each second circular cross-section portion within the second housing part at the same distance from the second face.

In one embodiment, the method comprises centering the first portion of each bore, within a bore position tolerance, from the first face.

In one embodiment, the method comprises centering the first portion of each bore, within the bore position tolerance together with a displacement tolerance of the rotor, from the first face.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Before discussing the embodiments in any more detail, first an overview will be provided. Embodiments provide a stator aperture arrangement which provides for an improved running-fit between a rotor and its stator, which reduces leakage and improves the performance of the pump. The aperture or bore within which the rotor is retained has semi-circular portions, with at least one of the semi-circular portions being offset by a distance which is up to a manufacturing tolerance of the location of opposing faces of a two-part stator which defines the bore. This arrangement provides for a reduced-size bore compared to conventional approaches. This reduced size bore still retains adequate running clearance, but reduces fluid leakage within the clearance gap between the rotor and the bore.

Stator

Figure 1:
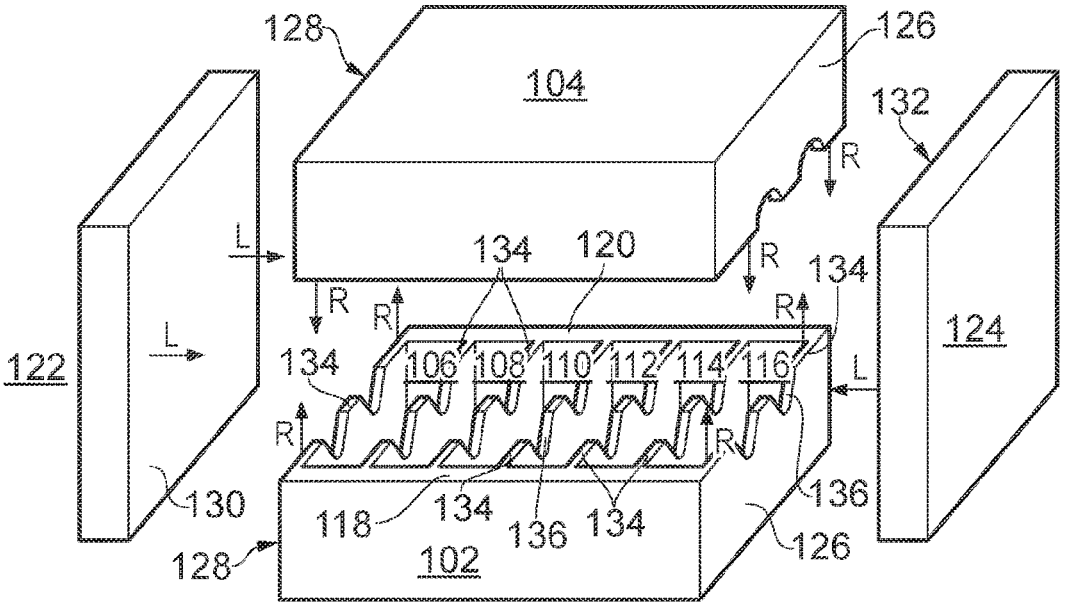
FIG. 1 is a schematic diagram showing the main components of a multi-stage roots or claw pump manufactured and assembled in the form of a clamshell.

FIG. 1 is a schematic diagram showing the main components of a multi-stage roots or claw pump manufactured and assembled in the form of a clamshell. The stator of such a pump comprises first and second half-shell stator components 102, 104 which together define a plurality of pumping chambers 106, 108, 110, 112, 114, 116. Each of the half-shell stator components 102, 104 has first and second longitudinally-extending faces which mutually engage with the respective longitudinally-extending faces of the other half-shell stator components 102, 104 when fitted together. Only two longitudinally-extending faces 118, 120 of half-shell stator component 102 are visible. During assembly, the two half-shell stator components 102, 104 are brought together in a transverse or radial direction shown by the arrows R.

The stator 100 further comprises first and second end stator components 122, 124. When the two half-shell stator components 102, 104 have been fitted together, the first and second end stator components 122, 124 are fitted to respective end faces 126, 128 of the joined two half-shell stator components 102, 104 in a generally axial or longitudinal direction shown by arrows L. Inner faces 130, 132 of the first and second end stator components 122, 124 mutually engage with respective end faces 126, 128 of the half-shell stator components 102, 104.

Each of the pumping chambers 106, 108, 110, 112, 114, 116 is formed between transverse walls 134 of the half-shell stator components 102, 104. Only the transverse walls 134 of the half-shell stator component 102 can be seen in FIG. 1. When the half-shell stator components 102, 104 are assembled, the transverse walls 134 provide axial separation between one pumping chamber and an adjacent pumping chamber, or between pumping chambers 106, 116 and the end stator components 122, 124.

Shafts of two longitudinally-extending rotors (not shown) are located in apertures 136 formed in the transverse walls 134 when the half-shell stator components 102, 104 are fitted together. Prior to assembly, lobes (not shown) are fitted to the shafts so that two lobes are located in each pumping chamber 106, 108, 110, 112, 114, 116. Although not shown in this simplified drawing, the end stator components 122, 124 each have two apertures through which the shafts extend. The shafts are supported by bearings (not shown) in the end stator components 122, 124 and are driven by a motor and gear mechanism (not shown).

Rotor

Figure 2:
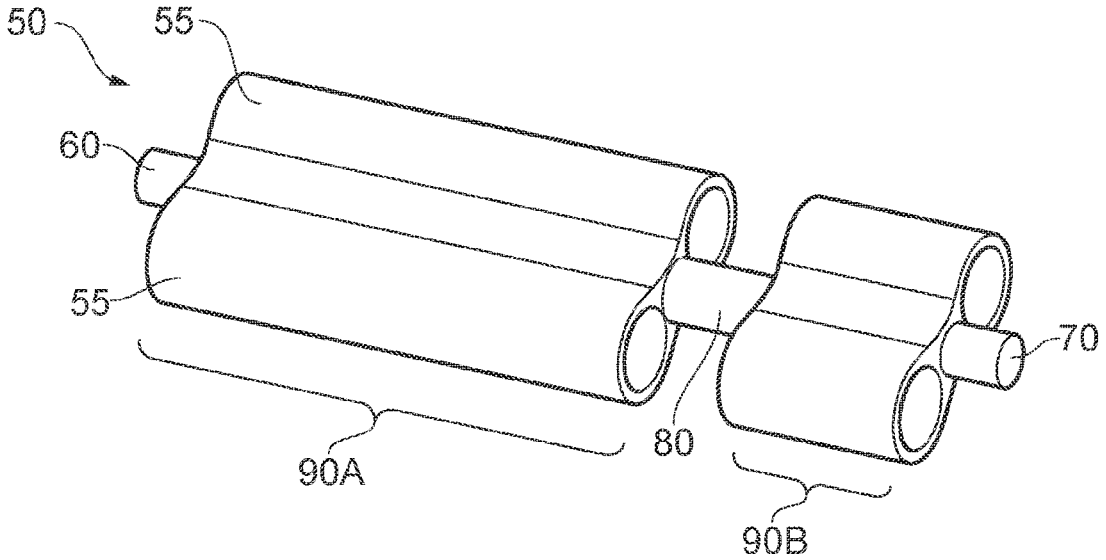
FIG. 2 is a perspective view of a simplified rotor.

FIG. 2 is a perspective view of a simplified rotor 50. In this example, the rotor is illustrated with two pairs of lobes, but it will be appreciated that more than two pairs may be provided (six pairs would be required for the pump shown in FIG. 1, one pair for each pumping chamber 106, 108, 110, 112, 114, 116). Also, more than pairs of lobes may be provided on the shaft (such as 3 or 4 lobes) and the lobes may be of a roots, claw or other type. As mentioned above, the rotor 50 is a rotor of the type used in a positive displacement lobe pump which utilizes meshing pairs of lobes. The rotor 50 has a pair of lobes formed symmetrically about a rotatable shaft. Each lobe 55 is defined by alternating tangential curved sections. In this example, the rotor 50 is unitary, machined from a single metal element and cylindrical voids extend through the lobes 55 to reduce mass.

A first axial end 60 of the shaft is received within a bearing provided by the end stator component and extends from a first rotary vane portion 90A which is received within the adjacent pumping chamber. An intermediate axial portion 80 extends from the first rotary vane portion 90A and is received within the aperture 136. The aperture 136 provides a close fit on the surface of the intermediate axial portion 80, but does not act as a bearing. Further rotary vane portions are then provided for each pumping chamber, each separated by an intermediate axial portion. A final rotary vane portion 90B extends axially from the intermediate axial portion 80 and is received within the final pumping chamber. A second axial end 70 extends axially from the final rotary vane portion 90B. The second axial end 70 is received by a bearing in the end stator component.

The multi-stage vacuum pump operates at pressures within the pumping chamber less than atmosphere and potentially as low as $10^{-3}$ mbar.

Accordingly, there will be a pressure differential between atmosphere and the inside of the pump. Leakage of surrounding gas into the pump and between each pumping chamber 106, 108, 110, 112, 114, 116 needs to be minimised.

Figure 3:
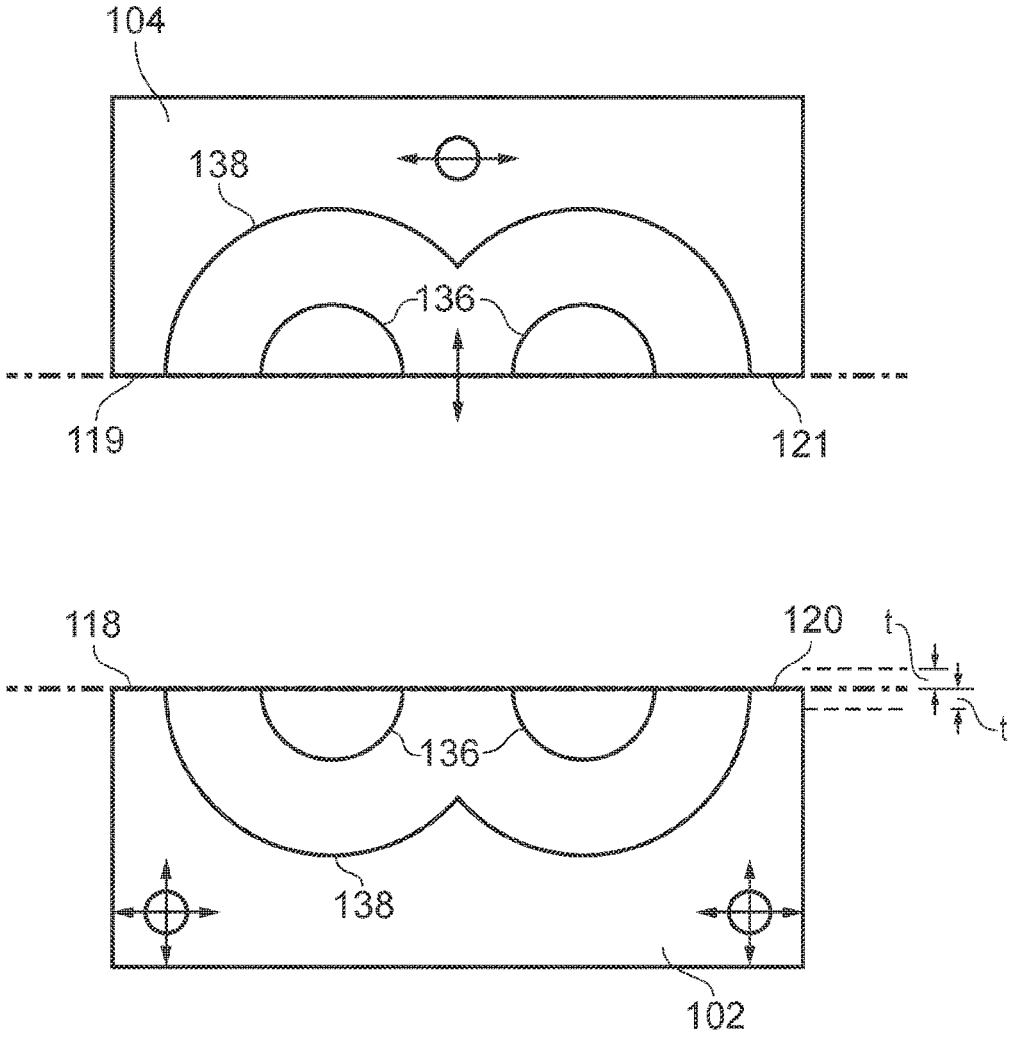
FIG. 3 is a schematic, sectional end-on view of the first and second half-shell stator components.

FIG. 3 is a schematic, sectional end-on view of the first and second half-shell stator components 102, 104. The apertures 136 are illustrated, together with apertures 138 within which the lobes 55 extend. The faces 118, 120 abut or engage with the faces 119, 121, as mentioned above, to provide the apertures 136, 138.

Conventional Aperture Configuration

Figure 4:
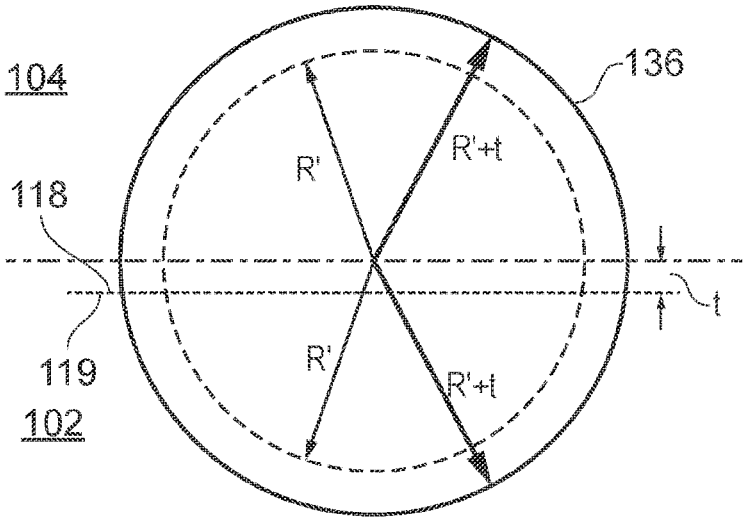
FIG. 4 illustrates a conventional technique for dimensioning the apertures.

FIG. 4 illustrates a conventional technique for dimensioning the apertures 136. Due to manufacturing tolerances, the location of the stator component 104 on the stator component 102 can vary vertically by up to a location tolerance, t. That is to say that the location of the faces 118, 120 can vary vertically by up to the location tolerance t.

Accordingly, this location tolerance t is added to the radius R' of the aperture 136 and the intermediate axial portion 80 to prevent contact between the aperture 136 and the rotor under worst-case conditions. It will be appreciated that all apertures which require a running clearance are dimensioned in the same way.

Modified Aperture Configuration

Figure 5:
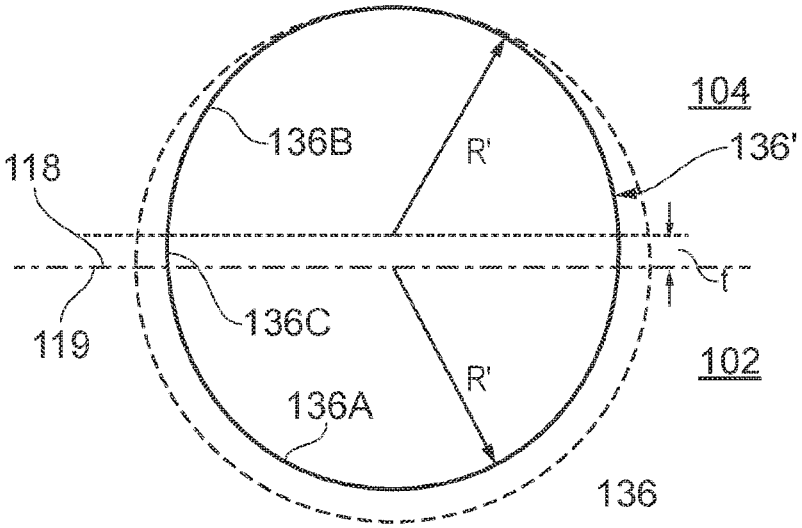
FIG. 5 shows the dimensioning of an aperture according to one embodiment.

FIG. 5 shows the dimensioning of an aperture 136' according to one embodiment. In this embodiment, the aperture 136' is discontinuous or irregular. In general, the aperture 136' is formed by a pair of vertically-displaced semi-circular aperture portions 136A, 136B having a reduced radius. In the embodiment shown, that portion 136A of the aperture 136' formed in the stator component 102 is semi-circular with a radius R' and does not include the location tolerance t. The centreline of the portion 136A of the aperture 136' runs along the face 118, 120. The portion 136B of the aperture 136' in the stator component 104 is semi-circular, but has its centre offset into the stator component 104 by the location tolerance t. Again, this aperture portion 136B of the aperture 136' has a radius R' which does not include the location tolerance t. In this embodiment, the portions 136C are straight, extending tangentially between the portions 136A and 136B. However, it will be appreciated that they need not be straight but may instead be circular or elliptical.

As can be seen in FIG. 5, this arrangement provides for a reduced-size aperture 136' compared to the aperture 136, while still providing for a running clearance between the aperture 136' and the intermediate axial portion 80. This reduced-size aperture 136' reduces leakage between the rotor 50 and the aperture 136' and improves the performance of the pump.

It will be appreciated that the same dimensioning approach can be used for each aperture for which a running clearance is required, such as the apertures 138. It will also be appreciated that the location of the aperture portion 136A on the face of the stator component 102 and the position of the aperture portion 136B within the stator component 104 will be within a positioning tolerance, which is typically much less than the location tolerance t.

For those arrangements where an additional displacement tolerance is required to account for displacement of the rotor caused by, for example, temperature or vibrational bending of the rotor 50, then that additional tolerance may be added to the location tolerance t.

Simulations were performed to calculate the improvements in pump pressure and power using the modified aperture configuration and the results are shown in Table 1.

TABLE 1

| | | Nominal pump | | Worst case pump | |
|---|---|---|---|---|---|
| Predicted performance benefits | | Inlet pressure mbar | Power W | Inlet pressure mbar | Power W |
| 0 slm (ultimate) | Conventional bores | 0.007 | 197 | 0.024 | 214 |
| | Modified bores | 0.004 | 193 | 0.012 | 203 |
| | Difference | −0.003 | −4 | −0.012 | −11 |
| 20 slm | Conventional bores | 12.3 | 594 | 15.8 | 675 |
| | Modified bores | 11.7 | 557 | 14.6 | 628 |
| | Difference | −0.6 | −37 | −1.2 | −47 |

It can be seen that nominal inlet pressure is significantly improved at ultimate (from 0.007 mbar to 0.004 mbar). Also, nominal shaft power is significantly reduced at 20 slm (37 Watts reduction), which is a significant saving for applications that run extensively over 10 mbar.

There are even greater gains in the pumps with larger than average clearances, which is expressed by the 'Worst case' figures. The more extreme pump builds will have improvements in ultimate pressure from 0.024 mbar to 0.012 mbar. This will greatly improve production yield, which will reduce manufacturing costs.

As mentioned above, in current clam-shell pump designs, the stator bore sizes in both clams are designed to accommodate the worst case stator alignment in both vertical and horizontal directions. The rotor to stator radial clearances in each pumping stage and each through bore are enlarged to allow for variability in the position of the interface between the two clams. This clearance increase in every stage leads has a negative effect on pump performance and life.

Current clam shell stator bore designs incorporate an allowance for the potential offset of the lower clam's top face. In contrast, embodiments of the invention employ an offset bore in the upper clam and a smaller bore size to deliver smaller radial clearances in the majority of radial directions. A cross-section of the upper stator bore of embodiments of the invention has a very short parallel section starting at the bottom face, followed by the usual semi-circular section. The length of the parallel section is equal to the half tolerance from the dowel holes to the top face of the lower clam. The values of this dimension on various current products include 0.05 mm, 0.025 mm and 0.04 mm.

The approach of embodiments of the invention can be introduced in all the pump stages and through bores in the clams. Pump performance in terms of ultimate pressure and power will be improved without any impact on cost or time to produce the clams. The same tooling can be used to machine the bores.

Accordingly, embodiments of the invention place the centre of the upper clam bore in a location which is offset from the lower face. Embodiments of the invention relate to any rotating machine with an axial split line between the stators. Specifically, embodiments of the invention include multi-stage Roots pumps and compressors.

It will be appreciated that embodiments of the invention provide for an arrangement which has stator bores in any orientation such as, for example, inverted, on its side, etc.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A pump, comprising:

a first housing part defining a first portion of a bore extending within said first housing part and shaped to receive a rotor; and a second housing part defining a second portion of said bore extending within said second housing part and shaped to receive said rotor, said first housing part having a first face abutable against an opposing second face of said second housing part to position said first portion of said bore with said second portion of said bore to receive said rotor, said first portion of said bore having a first circular cross-section portion centered along said first face and said second portion of said bore having a second circular cross-section portion, wherein a center of the second circular cross-section portion is offset into said second housing part at a distance from a plane that extends across said second portion of the bore and is defined in part by said second face.

2. The pump of claim 1, wherein a radius of said first circular cross-section portion and said second circular cross-section portion match an external radius of a portion of said rotor receivable therein.

3. The pump of claim 1, wherein said first portion of said bore defines a first hemi-cylinder portion having a longitudinal axis extending along said first face.

4. The pump of claim 1, wherein said second portion of said bore defines a second hemi-cylinder portion having a longitudinal axis extending parallel to said second face, within said second housing part at said distance from said plane.

5. The pump of claim 1, wherein said second portion of said bore has extension portions extending from said second circular cross-section portion to said second face.

6. The pump of claim 5, wherein said extension portions extend tangentially from either end of said second circular cross-section portion to said second face.

7. The pump of claim 5, wherein said extension portions have a length which matches said distance from said plane.

8. The pump of claim 1, wherein said first portion of said bore comprises a pair of intersecting first circular cross-section portions centered along said first face.

9. The pump of claim 1, wherein said first portion of said bore defines a pair of intersecting first hemi-cylinder portions having a longitudinal axis extending along said first face.

10. The pump of claim 1, wherein said second portion of said bore defines a pair of intersecting second circular cross-section portions centered, within said second housing part, at said distance from said plane.

11. The pump of claim 1, wherein said second portion of said bore defines a pair of intersecting second hemi-cylinder portions having a longitudinal axis extending parallel to said second face, within said second housing part at said distance from said plane, wherein said extension portions extend tangentially from either non-intersecting end of said second circular cross-section portions to said second face.

12. The pump of claim 1, wherein said distance comprises up to a location tolerance of said first face of said first housing part.

13. The pump of claim 1, wherein said distance comprises up to said location tolerance of said first face of said first housing part together with a displacement tolerance of said rotor.

14. The pump of claim 1, wherein said first housing part defines a plurality of first portions of bores shaped to receive said rotor and said second housing part defines a plurality of second portions of bores shaped to receive said rotor.

15. The pump of claim 14, wherein a radius of a first circular cross-section and a second circular cross-section portion of said plurality of first and second portions of bores matches an external radius of a portion of said rotor received therein.

16. The pump of claim 14, where said plurality of first portions of bores have a first circular cross-section centered along said first face and said plurality of second portions of bores have a second circular cross-section portion centered, within said second housing part, at said distance from said plane.

17. The pump of claim 14, wherein said plurality of second portions of bores have said second circular cross-section portion centered, within said second housing part, at the same distance from said plane.

18. The pump of claim 14, wherein said plurality of first portions of bores are centered, within a bore position tolerance, from said first face.

19. The pump of claim 18, wherein said plurality of first portions of bores are centered, within said bore position tolerance together with a displacement tolerance of said rotor, from said first face.

20. A method for forming a pump, comprising:

defining a first portion of a bore shaped to receive a rotor and extending within a first housing part;

defining a second portion of said bore shaped to receive said rotor and extending within a second housing part, said first housing part having a first face abutable against an opposing second face of said second housing part to position said first portion of said bore with said second portion of said bore to receive said rotor, centering said first portion of said bore having a first circular cross-section portion along said first face and centering said second portion of said bore having a second circular cross-section portion offset into, said second housing part, at a distance from a plane that extends across said second portion of the bore and is defined in part by said second face.

* * * * *